US007396117B2

(12) United States Patent
Hayashi et al.

(10) Patent No.: US 7,396,117 B2
(45) Date of Patent: Jul. 8, 2008

(54) LIQUID CONTAINER AND LIQUID EJECTING CARTRIDGE

(75) Inventors: Hiroki Hayashi, Yokohama (JP); Tatsuo Nanjo, Kawasaki (JP); Wataru Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 437 days.

(21) Appl. No.: 11/314,546

(22) Filed: Dec. 20, 2005

(65) Prior Publication Data

US 2006/0146105 A1 Jul. 6, 2006

(30) Foreign Application Priority Data

Jan. 6, 2005 (JP) ..... 2005-001354

(51) Int. Cl.
*B41J 2/175* (2006.01)

(52) U.S. Cl. ..... 347/86; 347/87

(58) Field of Classification Search ..... 347/84–87
See application file for complete search history.

(56) References Cited

U.S. PATENT DOCUMENTS 5,182,581 A * 1/1993 Kashimura et al. ..... 347/87
5,619,239 A 4/1997 Kotaki
6,585,360 B1 * 7/2003 Dietl ..... 347/86
6,817,706 B2 * 11/2004 Hou et al. ..... 347/86
6,910,763 B2 * 6/2005 Hou et al. ..... 347/86
6,942,326 B2 9/2005 Hayashi
2006/0132562 A1 * 6/2006 Nanjo et al. ..... 347/86

FOREIGN PATENT DOCUMENTS

JP 07-148937 6/1995
JP 2004-230702 8/2004

* cited by examiner

*Primary Examiner*—Stephen D. Meier
*Assistant Examiner*—Rene Garcia, Jr.
(74) *Attorney, Agent, or Firm*—Canon USA Inc IP Div

(57) ABSTRACT

A side rib provided on an inner wall of a housing creates space, which extends to reach an air hole, between a second ink retainer and the inner wall of the housing. A contact area where a first ink retainer and the second ink retainer are in contact with each other is provided with grooves that communicate with the space provided on the inner wall of the housing.

14 Claims, 12 Drawing Sheets

LIQUID CONTAINER AND LIQUID EJECTING CARTRIDGE

BACKGROUND OF THE INVENTION

1. Field of the Invention

The present invention relates to a liquid container that is used, for example, as an ink tank mounted on an inkjet recording apparatus and is brought into contact with an external member for supplying liquid thereto. The present invention also relates to a liquid ejecting cartridge that ejects liquid.

2. Description of the Related Art

In a known inkjet recording apparatus that performs recording by ejecting ink droplets, an inkjet head and an ink tank, which are separate, are brought together when the inkjet recording apparatus is used. To stably retain and supply ink during a recording operation to an inkjet head, an ink tank for such an inkjet recording apparatus needs to have a mechanism for generating appropriate back pressure (negative pressure). A known method for generating negative pressure utilizes a porous member, such as a urethane foam body, as a negative pressure generating member (ink absorber) to use the capillary force of the porous member.

Generally, the capillary force of a nozzle, according to the amount of ink consumed by an ejecting part, allows ink held by the porous member to flow from an ink supply port of the ink tank via a common reservoir to the ejecting part. Japanese Patent Laid-Open No. 7-148937 (corresponding U.S. Pat. No. 5,619,239) discloses a structure in which ribs for preventing ink leakage are provided in an ink tank.

An exemplary known ink tank using the capillary force will be described with reference to FIG. 8, FIG. 9A, and FIG. 9B.

FIG. 8 is an external perspective view of an ink tank and FIGS. 9A and 9B are cross-sectional views of the ink tank. FIG. 9A is a cross-sectional view taken along line IXA-IXA of FIG. 8, and FIG. 9B is a cross-sectional view taken along line IXB-IXB of FIG. 8. For the ease of explanation, the drawings show an ink tank 100 separated from a holder.

As shown in FIG. 8 and FIG. 9A, the ink tank 100 includes a housing constituting an ink container. The housing includes a main body 111*a* with an opening at the top and a lid member 111*b* for covering the opening of the main body 111*a*. The lid member 111*b* is provided with an air hole 115 for allowing air into the housing, and lid ribs 113 for allowing a space for buffering. The bottom of the main body 111*a* of the housing is provided with an ink supply port 114 for supplying ink to an inkjet head (not shown).

The housing contains a first ink retainer 150 and a second ink retainer 151 that are impregnated with and retain ink. The first ink retainer 150 is disposed between the second ink retainer 151 and the bottom of the ink tank 100. An end face of the first ink retainer 150 is in intimate contact with the second ink retainer 151 and blocks the ink supply port 114 from inside the housing.

As shown in FIG. 9A and FIG. 9B, the inner wall of the main body 111*a* is provided with a plurality of side ribs 112 surrounding the second ink retainer 151. The second ink retainer 151 contained in the housing is pressed against the side ribs 112 and creates clearances around the side ribs 112. The clearances are not filled with the second ink retainer 151 and communicate with the air hole 115.

The ink supply port 114 of the ink tank 100 is provided with a cap 117 for preventing ink leakage and evaporation during product distribution.

Although the first ink retainer 150 and the second ink retainer 151 are both impregnated with and retain ink, the ink retaining force (capillary force) of the first ink retainer 150 is larger than that of the second ink retainer 151. This enables ink retained by the second ink retainer 151 to smoothly flow into the first ink retainer 150 and increases efficiency of the consumption of the ink retained by the second ink retainer 151.

A mechanism based on the above-described structure for preventing ink leakage will now be described with reference to FIGS. 10A to 10C and FIGS. 11A to 11C.

FIGS. 10A to 10C and FIGS. 11A to 11C are cross-sectional views showing ink tanks capped for product distribution. In each ink tank, an air hole serving as an opening for allowing air into the ink tank faces downward. FIGS. 10A to 10C are cross-sectional views of an ink tank with no rib thereinside. FIGS. 11A to 11C are cross-sectional views of an ink tank with ribs thereinside.

First, an ink tank with no rib thereinside will be described with reference to FIGS. 10A to 10C.

When shock is applied to the ink tank 100 downward in the drawings (toward a surface on which the air hole 115 is provided) during product handling or the like, ink 119 retained near the ink supply port 114 in the ink retainers is moved toward the air hole 115. Since the ink retaining force of the first ink retainer 150 is larger than that of the second ink retainer 151, the ink 119 in the first ink retainer 150 is not easily moved by the application of the shock. Therefore, the ink 119 mainly in the second ink retainer 151 is moved toward the air hole 115.

As shown in FIG. 10B, voids 120 in which no ink 119 is retained are created, as the ink 119 moves, near the boundary between the first ink retainer 150 and the second ink retainer 151. When temperature or barometric pressure changes under this condition, the expansion of air in the voids 120, which are closed spaces surrounded by the ink 119, pushes the ink 119 in the second ink retainer 151 in directions indicated by arrows in FIG. 10C, and eventually causes the ink 119 to leak from the air hole 115 of the ink tank 100.

Next, an ink tank with ribs thereinside will be described with reference to FIGS. 11A to 11C.

When shock is applied to the ink tank 100 downward in the drawings (toward the surface on which the air hole 115 is provided) during product handling or the like, the voids 120 in which no ink 119 is retained are created, as the ink 119 moves, in the boundary between the first ink retainer 150 and the second ink retainer 151, as shown in FIG. 11B similar to those shown in FIG. 10B. When temperature or barometric pressure in the ink tank 100 with ribs thereinside changes, the voids 120 quickly communicate with clearances around the side ribs 112 and further communicate with the air hole 115. Therefore, as shown in FIG. 11C, air flows through air paths 123 indicated by broken lines and pushes almost no ink 119 outward.

As inkjet recording apparatuses become widespread, compact recording apparatuses with excellent portability have been developed. In such a compact recording apparatus, the size of its ink tank as well as the size of its main body is small.

Japanese Patent Laid-Open No. 2004-230702 (corresponding U.S. Pat. No. 6,942,326) discloses a structure that increases the efficiency of the use of space in a known compact ink tank and allows stable supply operations of the ink tank.

The structure will now be described with reference to FIG. 12 and FIG. 13. FIG. 12 is an exploded perspective view showing an external appearance of a known ink tank and inkjet head with holder before being put together, and FIG. 13 is an exploded partial cutaway perspective view of FIG. 12.

As shown in FIG. 12 and FIG. 13, an inkjet cartridge 130 includes an ink tank 100, a holder 131 detachably holding the ink tank 100, and an inkjet head 132 that is integral with the holder 131 and ejects ink.

The inkjet head 132 is provided at the bottom of the holder 131 in use mode during which ink is ejected, and has a group of outlets (not shown) for ejecting ink supplied from the ink tank 100. The holder 131 is provided with a projecting ink receiving tube (external member) 133 at a connection to the ink tank 100. The ink receiving tube 133 communicates via an ink supply path (not shown) with the group of outlets of the inkjet head 132.

As shown in FIG. 12, the ink tank 100 includes a housing 111 constituting an ink container. The housing 111 includes a main body 111*a* with an opening at the top and a lid member 111*b* for covering the opening of the main body 111*a*. The lid member 111*b* is provided with an air hole 115 and lid ribs 113 for allowing space for buffering.

As shown in FIG. 13, the bottom of the main body 111*a* of the housing 111 is provided with an ink supply port 114 that is opposite the ink receiving tube 133 when the ink tank 100 is attached to the holder 131. The housing 111 contains a first ink retainer 150 and a second ink retainer 151 that are impregnated with and retain ink.

The first ink retainer 150 is disposed between the second ink retainer 151 and the bottom of the ink tank 100. The first ink retainer 150 is in intimate contact with the second ink retainer 151 and blocks the ink supply port 114 from inside the ink tank 100. The first ink retainer 150 is formed substantially into the inner shape of a portion (undersurface) of the housing 111, the portion in which the ink supply port 114 is provided. The ink retaining force (capillary force) of the first ink retainer 150 is larger than that of the second ink retainer 151.

Since the first ink retainer 150 is formed substantially into the inner shape of the undersurface of the housing 111 in the structure described above, an area impregnated with ink increases inside the ink tank 100. This allows a relatively large amount of ink to be retained in a small ink tank. Moreover, even if ink is supplied at high speed, the amount of unused ink remaining in the ink tank 100 can be reduced and the efficiency of ink use can be increased.

If the first ink retainer 150 is in sheet form, a local deformation that occurs when brought into contact with an external member can be accommodated by the first ink retainer 150 as a whole, and neighboring voids generated by the buckling of the first ink retainer 150 can be minimized. Moreover, reducing the internal volume of the first ink retainer 150 having a relatively large capillary force can reduce the amount of ink remaining inside the first ink retainer 150 and increase the efficiency of ink use.

As inkjet recording apparatuses become widespread, compact recording apparatuses with excellent portability have been proposed these days. In such a compact recording apparatus, the size of its ink tank as well as the size of its main body is small. An important point for such a compact ink tank is how to avoid ink leakage without reducing the efficiency of space use.

However, in a known structure, many ribs for avoiding ink leakage are provided on the inner surface of a housing of an ink tank and create space between an ink retainer and the inner surface of the housing. Therefore, the amount of space in which the ink retainer retains ink is reduced by the amount of space created by the ribs.

As disclosed in the above-described Japanese Patent Laid-Open No. 2004-230702 (corresponding U.S. Pat. No. 6,942,326), in the ink tank 100 in which the first ink retainer 150 is disposed over the entire undersurface of the housing 111 to increase the efficiency of ink use, a large enclosed air space is created between the first ink retainer 150 and the second ink retainer 151 because of the large area of the first ink retainer 150, and the possibility of ink leakage increases. However, if more ribs are added to increase resistance to ink leakage, the amount of space in which ink is retained is further reduced.

SUMMARY OF THE INVENTION

The present invention is directed to a compact liquid container that includes a liquid retaining member capable of absorbing and retaining an increased amount of liquid and has an improved reliability in preventing liquid leakage. The present invention is also directed to a liquid ejecting cartridge that includes such a liquid container.

According to one aspect of the present invention, a liquid container includes a liquid retaining member configured to retain a liquid, a housing configured to house the liquid retaining member, a liquid supply opening provided on the housing and configured to supply liquid in the liquid retaining member to an external member, and an air intake opening provided on the housing and configured to bring air into the housing. The liquid retaining member includes a first liquid retaining member capable of being brought into contact with the external member and a second liquid retaining member contacting the first liquid retaining member and configured to supply liquid to the first liquid retaining member. A liquid retaining force of the first liquid retaining member is larger than that of the second liquid retaining member. Space reaching the air intake opening is defined, between the second liquid retaining member and an inner surface of the housing, by one of a concave portion and convex portion on the inner surface. At least one void communicating with the space on the inner surface of the housing is provided within a contact area where the first liquid retaining member and the second liquid retaining member are in contact with each other.

As described above, in the present invention, the area where the first liquid retaining member is in contact with the second liquid retaining member is provided with a void that communicates via a space with the air intake opening. This enables closed spaces surrounded by liquid in the second liquid retaining member to be efficiently opened to the atmosphere, and thus prevents the leakage of liquid using a relatively small amount of space. Therefore, the present invention substantially improves the efficiency of the use of space in the liquid container and increases the amount of liquid that can be absorbed by the liquid retaining member even if the liquid container is relatively small in size.

Further features of the present invention will become apparent from the following description of exemplary embodiments with reference to the attached drawings.

BRIEF DESCRIPTION OF THE DRAWINGS

FIGS. 10A to 11C are cross-sectional views sequentially showing the movement of ink in a known ink tank with no rib.

FIGS. 11A to 11C are cross-sectional views sequentially showing the movement of ink in a known ink tank with ribs.

DESCRIPTION OF THE EMBODIMENTS

Embodiments of the present invention will now be described in detail with reference to the drawings. The drawings are provided only to schematically illustrate each embodiment, and the ratio of sizes of parts in each drawing may differ from that in the actual structure.

First Embodiment

Figure 1A:
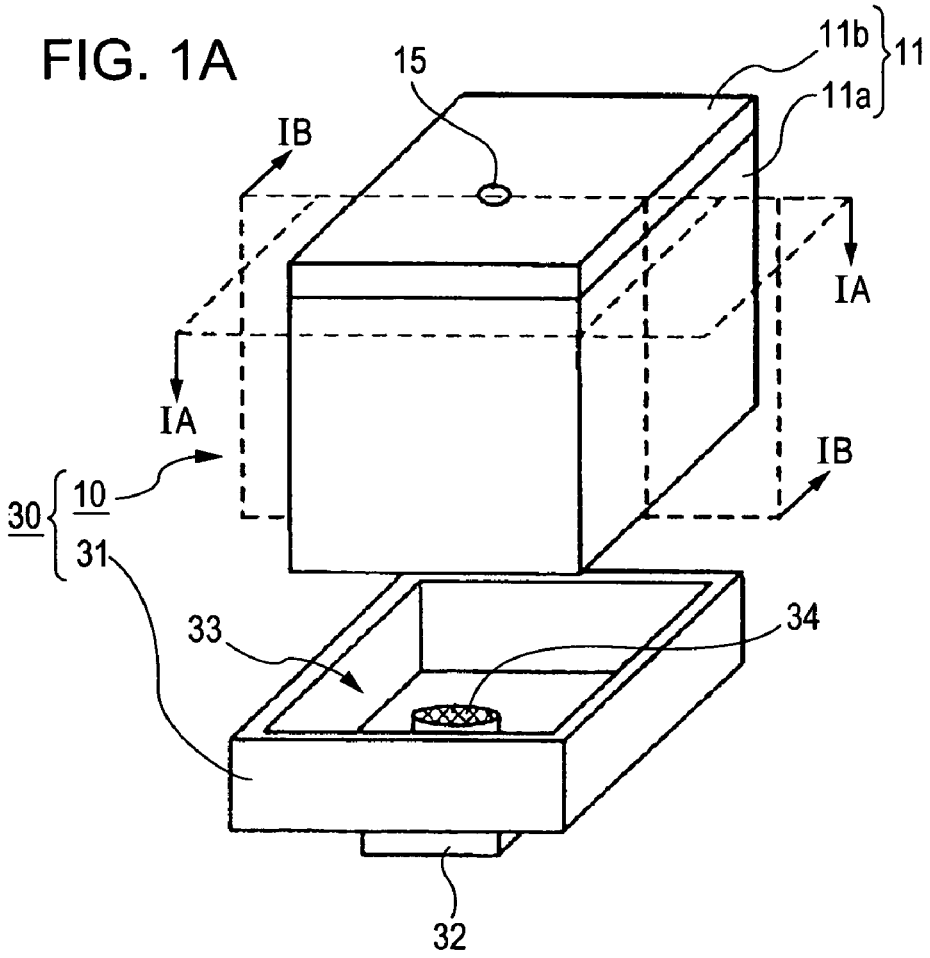
FIG. 1A is an exploded perspective view showing an external appearance of an ink tank and an inkjet head with holder before being put together, according to a first embodiment of the present invention.
Figure 1B:
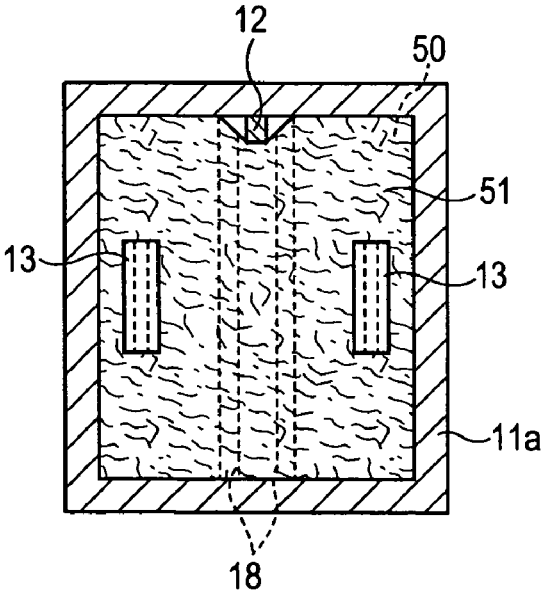
FIG. 1B is a cross-sectional view taken along line IA-IA of FIG. 1A.
Figure 1C:
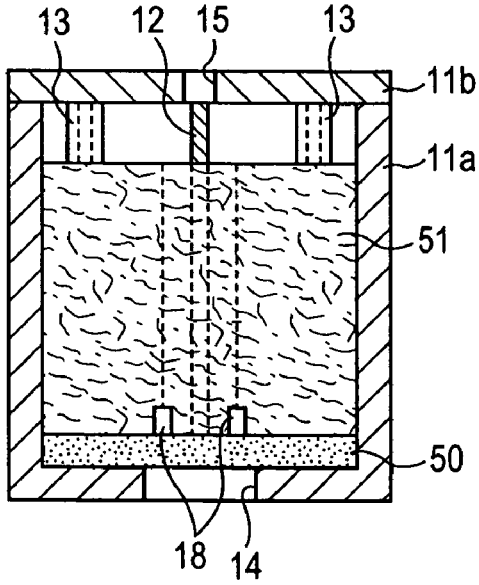
FIG. 1C is a cross-sectional view taken along line IB-IB of FIG. 1A.
Figure 2:
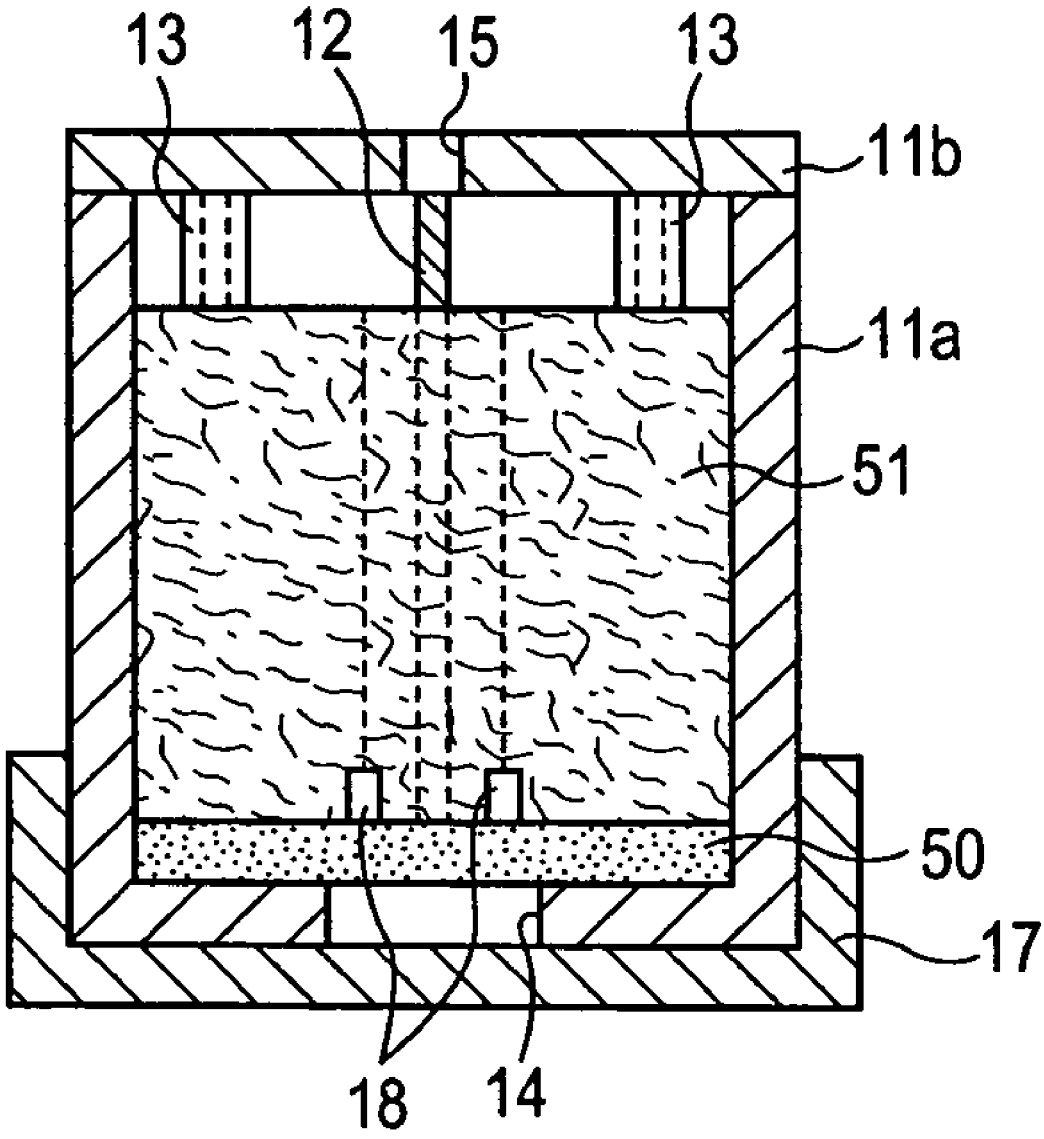
FIG. 2 is a cross-sectional view of the ink tank according to the first embodiment.

The first embodiment of the present invention will be described with reference to the drawings. FIG. 1A is an exploded perspective view of an inkjet cartridge 30. FIG. 1B and FIG. 1C are cross-sectional views showing an ink tank 10. FIG. 1B is a cross-sectional view taken along line IA-IA of FIG. 1A. FIG. 1C is a cross-sectional view taken along line IB-IB of FIG. 1A. FIG. 2 is a cross-sectional view showing the form of product distribution of the ink tank 10 in FIG. 1C. For ease of explanation, a holder 31 and the ink tank 10 are separated in the drawings.

As in FIGS. 1A to 1C and FIG. 2, the inkjet cartridge 30 includes the ink tank 10 serving as an ink container, the holder 31 detachably holds the ink tank 10, and an inkjet head 32 that is integral with the holder 31 and ejects ink.

The ink tank 10 contains ink (e.g. black ink) that is liquid to be supplied to the inkjet head 32. For convenience in explaining the structure, ink retained in ink retainers is not shown in FIGS. 1A to 1C.

The inkjet head 32 is provided at the bottom of the holder 31 in use mode during which ink is ejected, and has a group of outlets (not shown) for ejecting ink supplied from the ink tank 10. The holder 31 is provided with a projecting ink receiving tube (external member) 33 at a connection to the ink tank 10. The ink receiving tube 33 communicates via an ink supply path (not shown) with the group of outlets of the inkjet head 32. The ink receiving tube 33 is provided with a filter 34 at the top for preventing the entrance of foreign particles into the ink receiving tube 33. Attaching the ink tank 10 to the holder 31 allows ink in the ink tank 10 to be supplied via the ink receiving tube 33 and ink supply path to the inkjet head 32 having the group of outlets from which ink is ejected.

As shown in FIG. 1A, the ink tank 10 includes a housing 11 constituting an ink container. The housing 11 includes a main body 11*a* with an opening at the top and a lid member 11*b* for covering the opening of the main body 11*a*. As shown in FIG. 1C, the lid member 11*b* is provided with an air hole 15 for allowing air into the housing 11 and lid ribs 13 for allowing space for buffering.

As shown in FIG. 1C, the bottom of the main body 11*a* of the housing 11 is provided with an ink supply port 14 that is opposite the ink receiving tube 33 when the ink tank 10 is attached to the holder 31. An O-ring (not shown) is provided around the ink receiving tube 33 such that ink supplied from the ink tank 10 through the ink receiving tube 33 is prevented from leaking into the holder 31 and is prevented from evaporating.

The housing 11 contains a first ink retainer 50 and a second ink retainer 51 that are impregnated with and retain ink. The first ink retainer 50 is disposed between the second ink retainer 51 and the bottom of the ink tank 10. An end face of the first ink retainer 50 is in intimate contact with the second ink retainer 51 and blocks the ink supply port 14 from inside the housing 11. The first ink retainer 50 is formed substantially into the inner shape of a portion (undersurface) of the housing 11, the portion in which the ink supply port 14 is provided. As shown in FIG. 2, the ink supply port 14 of the ink tank 10 is normally covered with a cap 17 for preventing ink leakage and evaporation during product distribution.

In the present embodiment, the ink retaining force (capillary force) of the first ink retainer 50 is larger than that of the second ink retainer 51. This enables ink retained by the second ink retainer 51 to smoothly flow into the first ink retainer 50 and increases efficiency of the consumption of the ink retained by the second ink retainer 51.

Specifically, the first ink retainer 50 and the second ink retainer 51 are laminated fiber assemblies in which webs of polyolefin thermoplastic resin fibers arranged substantially in one direction are laminated and compressed in the direction of lamination. The first ink retainer 50 is composed of fibers, each measuring about 2.2 dtex in thickness (about 18 μm in diameter), and the density of the fibers after being compressed is about 0.20 g/cm$^3$. The second ink retainer 51 is composed of fibers, each measuring about 6.7 dtex in thickness (about 54 μm in diameter), and the density of the fibers after being compressed is about 0.08 g/cm$^3$. While the thickness of the second ink retainer 51 in the direction along which the second ink retainer 51 is brought into contact with the ink receiving tube 33 is about 12.5 mm, the thickness of the first ink retainer 50 in the direction along which the first ink retainer 50 is brought into contact with the ink receiving tube 33 is about 1.5 mm. That is, the first ink retainer 50 is in sheet form.

Attaching the ink tank 10 to the holder 31 allows the ink receiving tube 33 to come into contact via the ink supply port 14 with the first ink retainer 50, and allows ink retained by the first ink retainer 50 to be supplied via the ink receiving tube 33 and ink supply path (not shown) to the group of outlets of the inkjet head 32. In the present embodiment, when the ink receiving tube 33 comes into contact with the first ink retainer 50, the amount the ink receiving tube 33 presses the first ink retainer 50 is set at about 0.5 mm.

The contact surface (boundary surface) between the first ink retainer 50 and the second ink retainer 51 is provided with linear grooves 18 that are voids extending outwardly. Specifically, the second ink retainer 51 is provided with linear and notched grooves that create voids on a surface that is in contact with the first ink retainer 50. The grooves 18 are parallel to each other, with the center of the contact surface of the second ink retainer 51 interposed therebetween. The grooves 18 are formed by stamping with dies when the second ink retainer 51 is produced.

One side of the inner surface of the main body 11*a* is provided with a side rib 12 for enabling the grooves 18 to communicate with the air hole 15. The side rib 12 creates a channel (air path) that allows air to flow between a side of the second ink retainer 51 and the inner surface of the housing 11. As shown in FIG. 1C, the grooves 18 are arranged such that the side rib 12 is positioned therebetween.

Like the first ink retainer 50 and second ink retainer 51 described above, the housing 11 of the ink tank 10 of the present embodiment, that is, the main body 11*a* and the lid member 11*b* are made of polyolefin resin material. This eliminates the need to take apart the ink tank 10 after use to discard it according to the type of material, and enables easy recycling and reuse, and thus is environmentally friendly.

A mechanism for preventing ink leakage in the ink tank 10 having the above-described structure will now be described with reference to FIG. 3A to FIG. 3C.

Figure 3A:
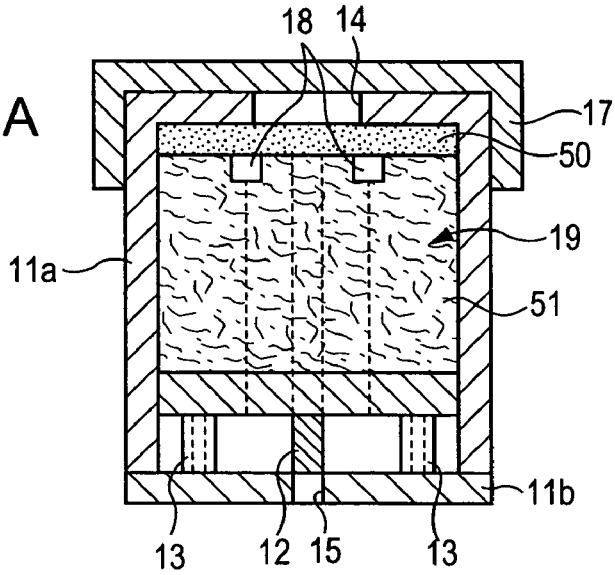
FIG. 3A to FIG. 3C are cross-sectional views sequentially showing the movement of ink in the ink tank of the first embodiment.
Figure 3B:
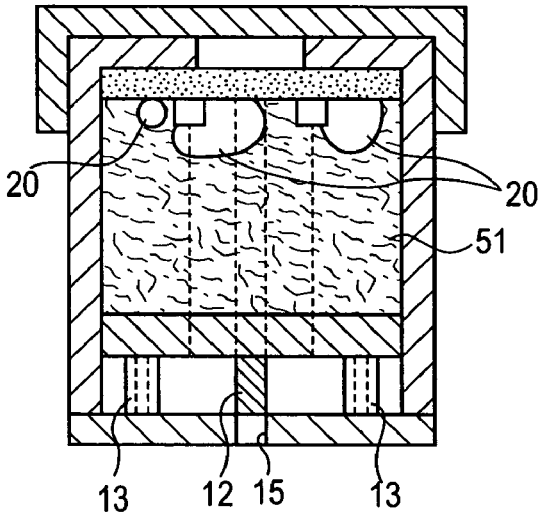
Figure 3C:
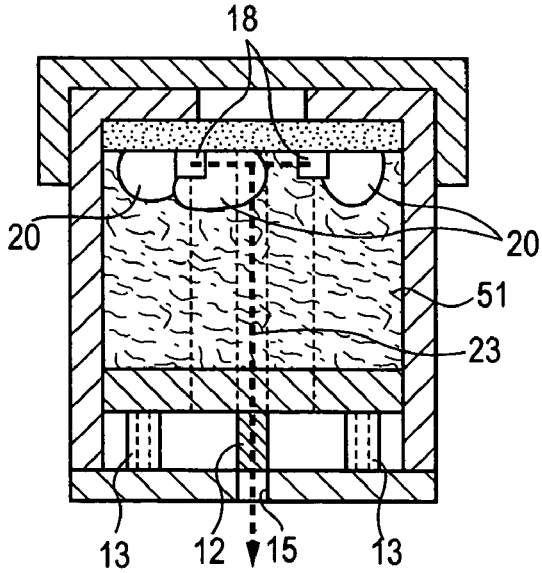

FIGS. 3A to 3C are cross-sectional views showing the ink tank 10 with the cap 17 for product distribution. FIG. 3A shows the ink tank 10 with the air hole 15 facing downward.

When shock is applied to the ink tank 10 downward in FIG. 3A during product handling or the like, ink 19 retained near the ink supply port 14 in the first ink retainer 50 is moved toward the air hole 15. Since the ink retaining force of the first ink retainer 50 is larger than that of the second ink retainer 51, the ink 19 in the first ink retainer 50 cannot be easily moved by the application of shock. Therefore, the ink 19 mainly in the second ink retainer 51 is moved toward the air hole 15. Thus, as shown in FIG. 3B, voids 20 in which no ink 19 is retained are created, as the ink 19 moves, near the boundary between the first ink retainer 50 and the second ink retainer 51.

If temperature or barometric pressure changes, air in the voids 20, which are closed spaces surrounded by the ink 19, normally expands or contracts, and the ink 19 in the second ink retainer 51 is pushed toward the air hole 15. However, in the structure according to the present embodiment, the voids 20 promptly communicate with the grooves 18 and connect with the air hole 15. This allows air to flow, as indicated by a broken arrow in FIG. 3C, through an air path 23 that the side rib 12 defines between the periphery of the second ink retainer 51 and the inner surface of the housing 11, and to be released into the atmosphere. Therefore, almost no ink 19 is pushed toward the air hole 15.

Figure 9A:
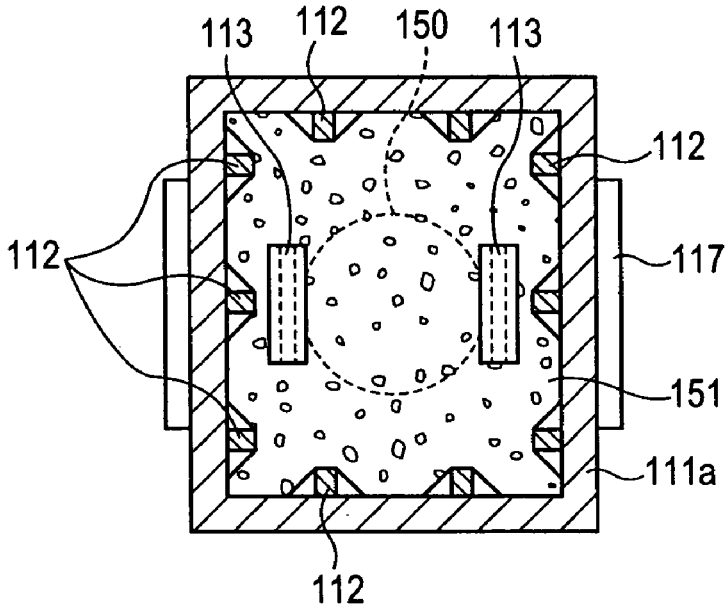
FIG. 9A PRIOR ART
FIG. 9A is a cross-sectional view taken along line IXA-IXA of FIG. 8.
Figure 9B:
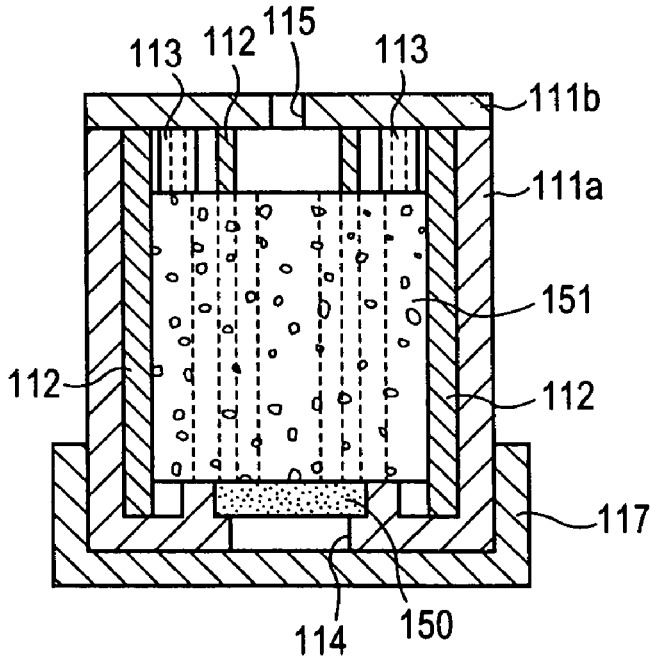
FIG. 9B PRIOR ART
FIG. 9B is a cross-sectional view taken along line IXB-IXB of FIG. 8.
Figure 10A:
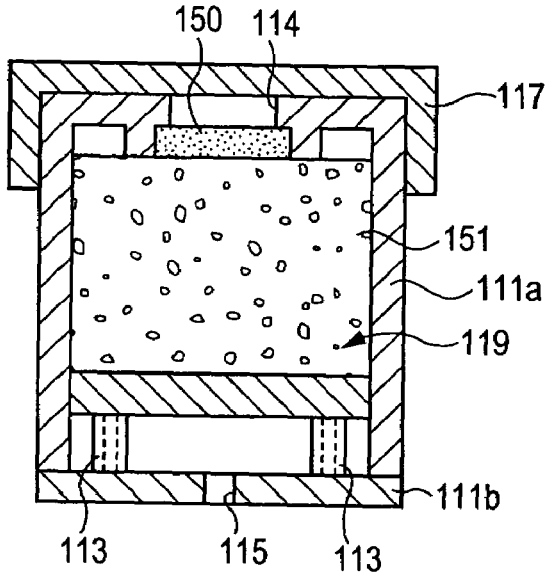
FIG. 10A PRIOR ART
Figure 10B:
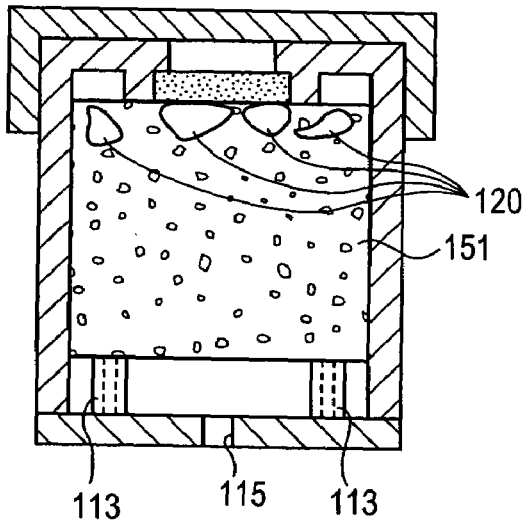
FIG. 10B PRIOR ART
Figure 10C:
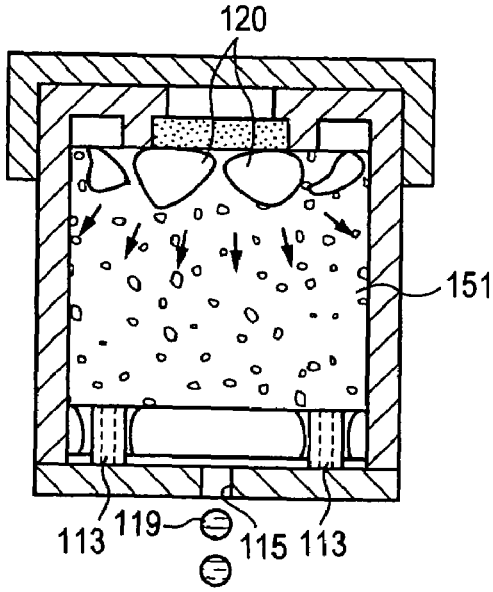
FIG. 10C PRIOR ART
Figure 11A:
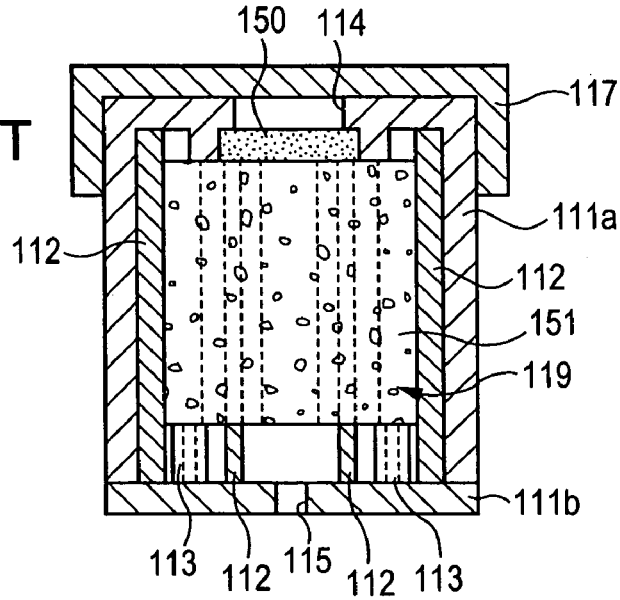
FIG. 11A PRIOR ART
Figure 11B:
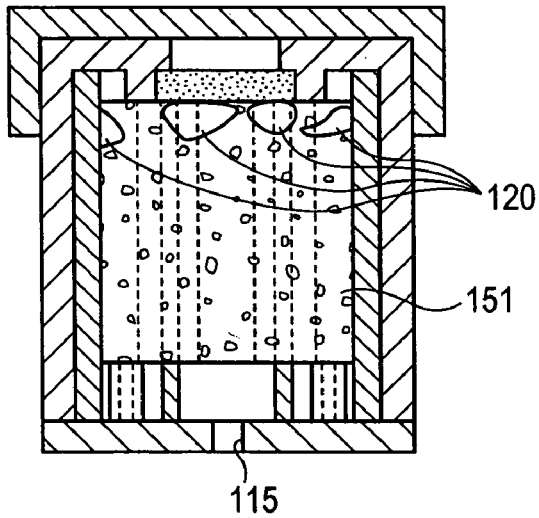
FIG. 11B PRIOR ART
Figure 11C:
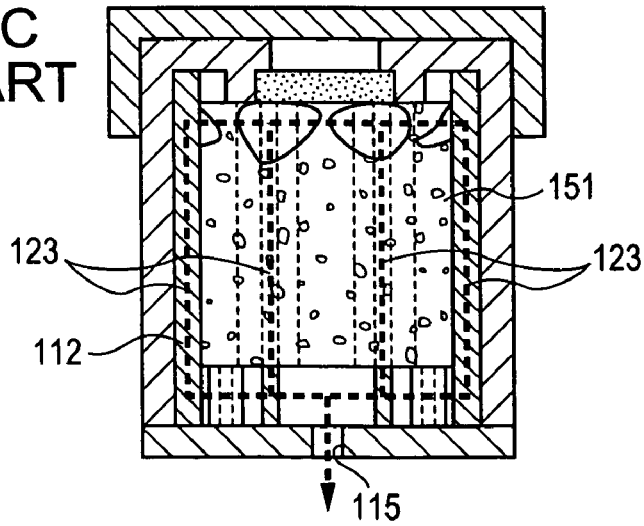
FIG. 11C PRIOR ART
Figure 12:
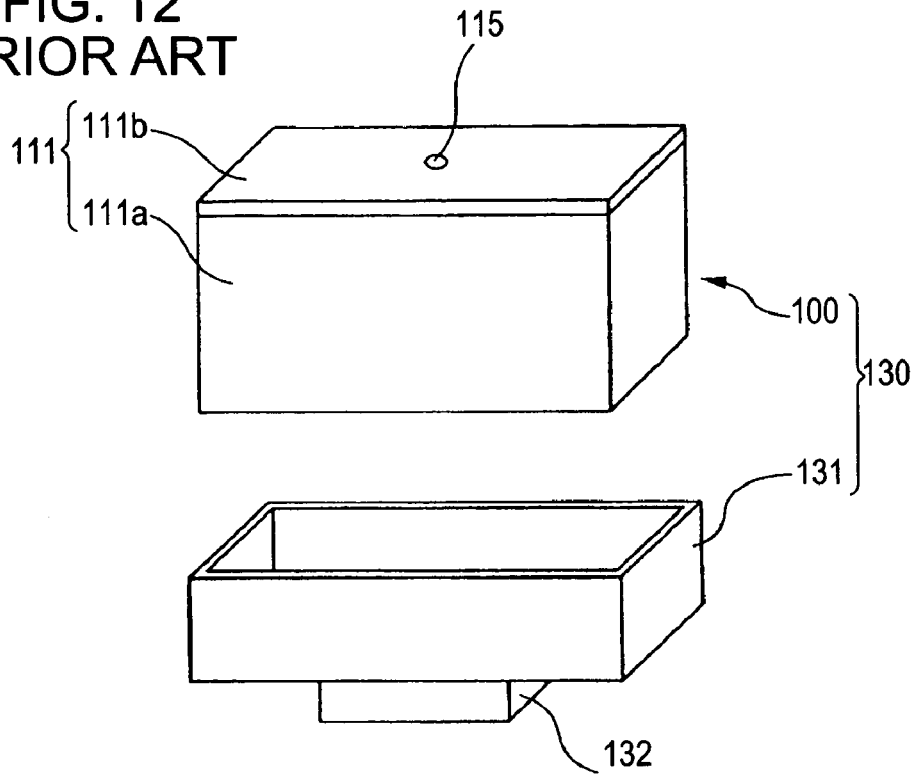
FIG. 12 PRIOR ART
FIG. 12 is an exploded perspective view showing an external appearance of a known ink tank and inkjet head with holder before being assembled together.
Figure 13:
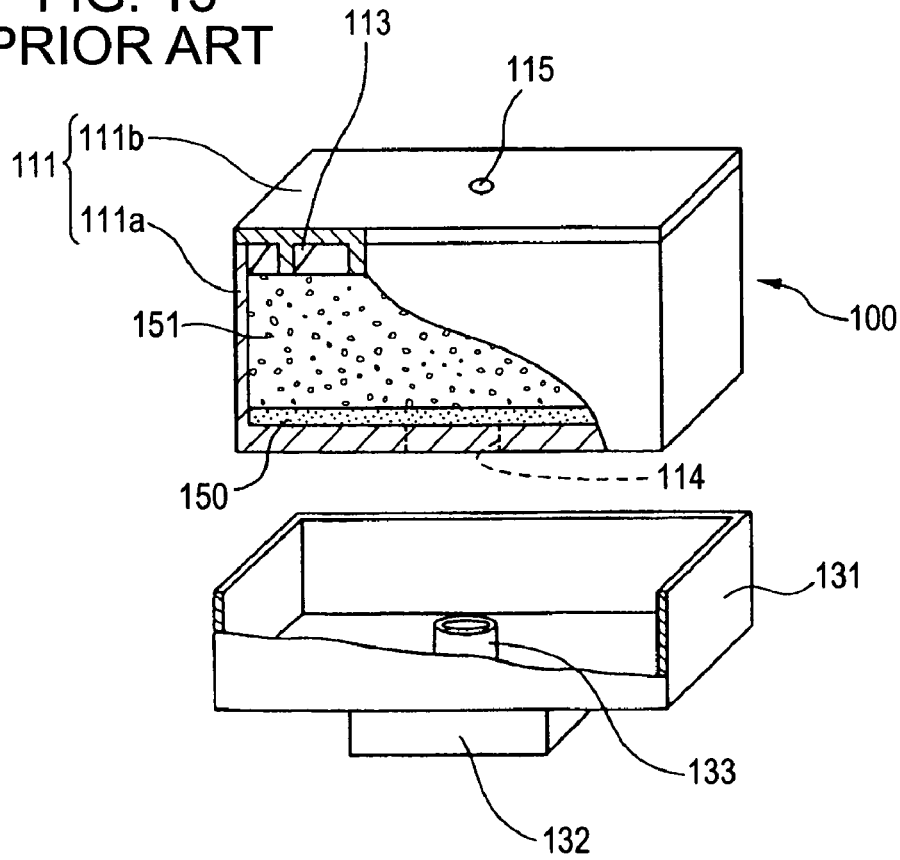
FIG. 13 PRIOR ART
FIG. 13 is an exploded partial cutaway perspective view showing an external appearance of the known ink tank and inkjet head with holder before being assembled together.

In the structure described above, it is only required that the air path 23 between the periphery of the second ink retainer 51 and the inner surface of the housing 11 be arranged such that the grooves 18 and the air hole 15 communicate with each other. Since the number of air paths in the housing 11 can be minimized, reliability in preventing ink leakage can be ensured with a relatively small number of air paths compared to the structure shown in FIG. 9A, and the efficiency of the use of space in the housing 11 can be substantially improved. In other words, in the ink tank 10 of the present embodiment, since only one side of the inner surface of the housing 11 is provided with the side rib 12 and other sides are in contact with the periphery of the second ink retainer 51, the size of the ink tank 10 can be reduced and the amount of ink absorbed and retained by the second ink retainer 51 can be increased.

While the ink tank 10 of the present embodiment is in the form for product distribution, an ink tank mounted on a carriage (not shown) of an inkjet recording apparatus can achieve similar effects.

While voids created between the first ink retainer 50 and the second ink retainer 51 are in the form of linear grooves in the present embodiment, the voids may be in different forms. For example, the contact surface of the first ink retainer 50 or the second ink retainer 51 may be provided with projections, which create voids that constitute part of the air path.

Moreover, the grooves 18 constituting part of the air path between the first ink retainer 50 and the second ink retainer 51 and provided in the second ink retainer 51 in the present embodiment may be provided in the first ink retainer 50, or may be provided in both the first ink retainer 50 and second ink retainer 51.

Second Embodiment

An ink tank of the second embodiment will now be described with reference to the drawings. In the second embodiment, the same components as those in the first embodiment are given the same reference numerals and their descriptions will be omitted.

Figure 4A:
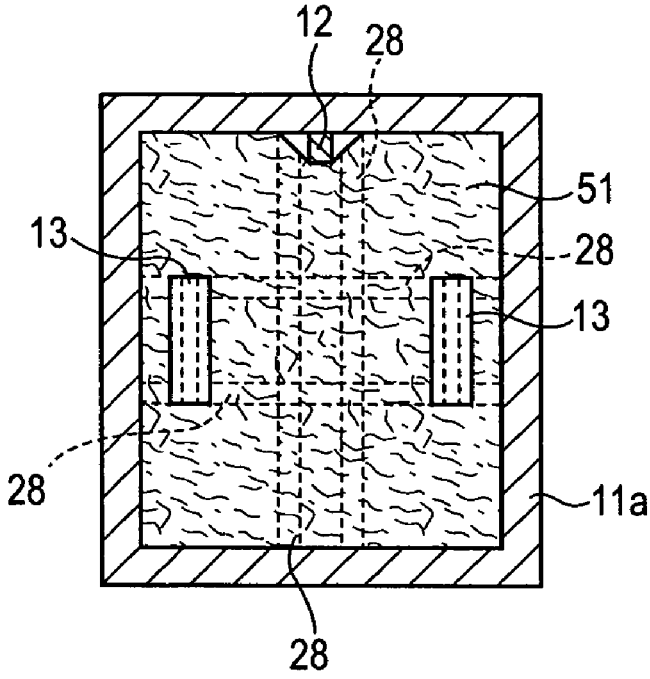
FIG. 4A and FIG. 4B are cross-sectional views showing an ink tank of a second embodiment.
Figure 4B:
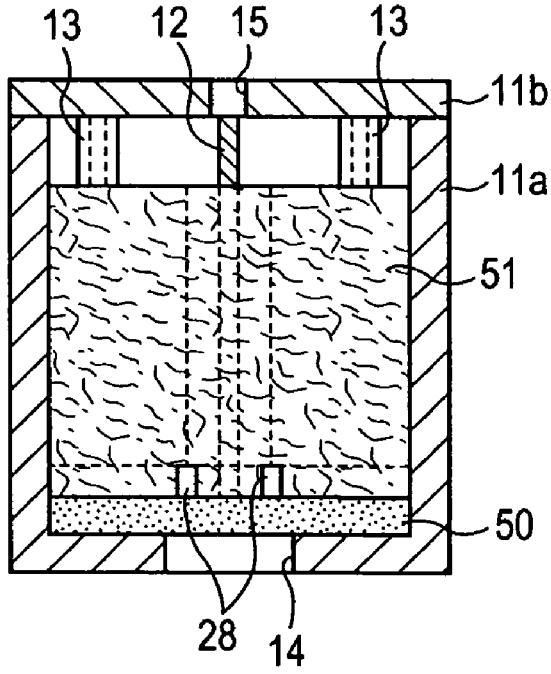

FIG. 4A and FIG. 4B are cross-sectional views showing an ink tank 10 of the second embodiment. Similar to the first embodiment, a first ink retainer 50 is disposed between a second ink retainer 51 and the bottom of the ink tank 10. The first ink retainer 50 is in intimate contact with the second ink retainer 51 and blocks an ink supply port 14 from inside the ink tank 10. The first ink retainer 50 is formed substantially into the inner shape of a portion (undersurface) of a housing 11, the portion in which the ink supply port 14 is provided. The ink retaining force (capillary force) of the first ink retainer 50 is larger than that of the second ink retainer 51.

Figure 5A:
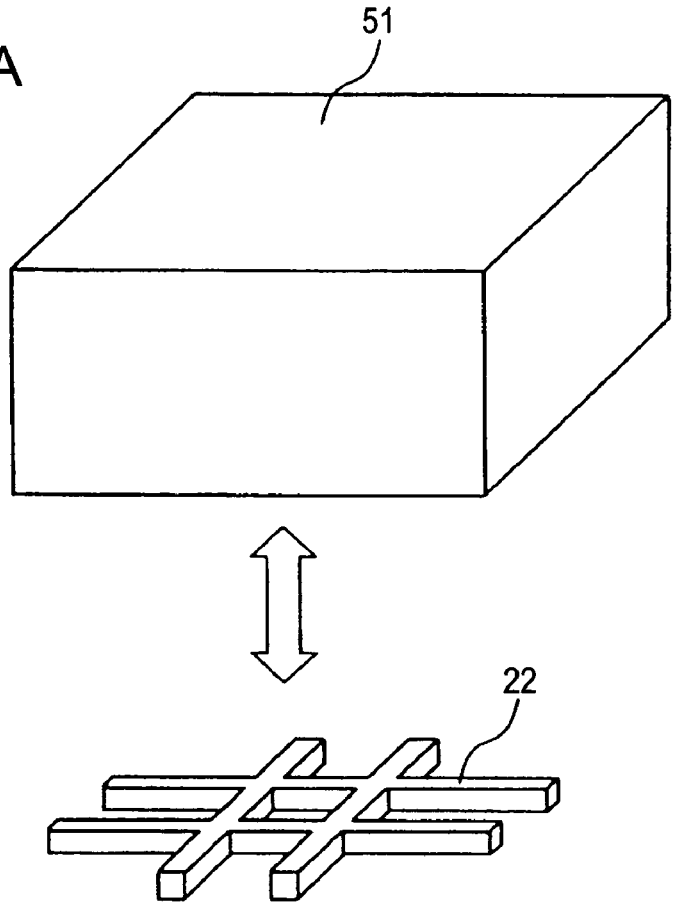
FIG. 5A and FIG. 5B are perspective views showing a method for forming grooves in an ink retainer of the second embodiment.
Figure 5B:
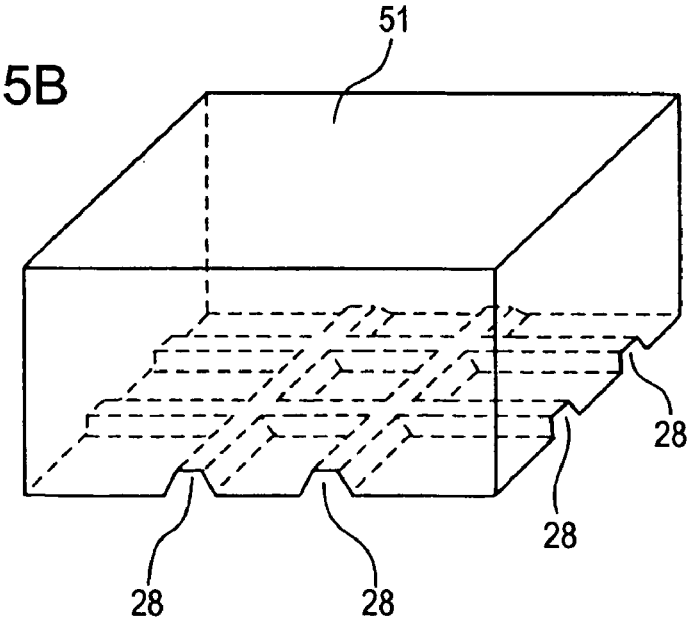

A method for forming grooves according to the present embodiment will now be described with reference to FIG. 5A and FIG. 5B.

As shown, a grid member 22 is pressed against a surface of the second ink retainer 51 that is to be in contact with the first ink retainer 50. The portion against which the grid member 22 is pressed is melted with heat and formed into grid-like grooves 28. Similar to the first embodiment, since an end of the grooves 28 communicates with the air hole 15 via an air path defined by a side rib 12 on a side wall of the housing 11, the resistance to ink leakage can be improved.

Compared to the first embodiment in which the grooves 18 are formed by stamping, the production method of the present embodiment allows for easy formation of grooves with relatively complex shapes, such as grid shapes, and increases the degree of freedom in the shape of grooves.

Moreover, since the grooves 28 of the present embodiment are formed by melting the second ink retainer 51 with heat, the portions of the grooves 28 become more dense with fine pores than the other portions and can be tightly formed into groove shapes. Therefore, even if the portions of the grooves 28 are compressed when, for example, attaching an inkjet head 32 to a holder 31 allows an ink receiving tube 33 to be inserted into the ink supply port 14, the shapes of the grooves 28 can be firmly maintained in good condition, and the grooves 28 can function as part of the air path in a stable manner.

As described above, since the grooves 28 of the present embodiment are formed by melting the second ink retainer 51 with heat, the portions of the grooves 28 become more dense with fine pores than other portions. Therefore, the ink retaining force of the top surface of these portions becomes larger than that of the other portions. This prevents air from entering through the grooves 28 into the second ink retainer 51.

While the air path provided between the first ink retainer 50 and the second ink retainer 51 is in the form of grooves in the present embodiment, the air path may be in different forms. For example, the contact surface of the first ink retainer 50 or the second ink retainer 51 may be provided with projections, which create voids that constitute part of the air path.

Moreover, the grooves 28 constituting part of the air path between the first ink retainer 50 and the second ink retainer 51 and provided in the second ink retainer 51 in the present embodiment may be provided in the first ink retainer 50, or may be provided in both the first ink retainer 50 and second ink retainer 51.

Third Embodiment

Figure 6A:
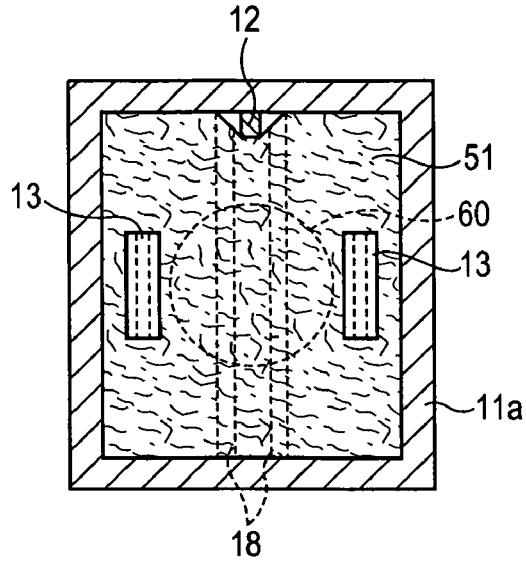
FIG. 6A to FIG. 6C are cross-sectional views showing an ink tank of a third embodiment.
Figure 6B:
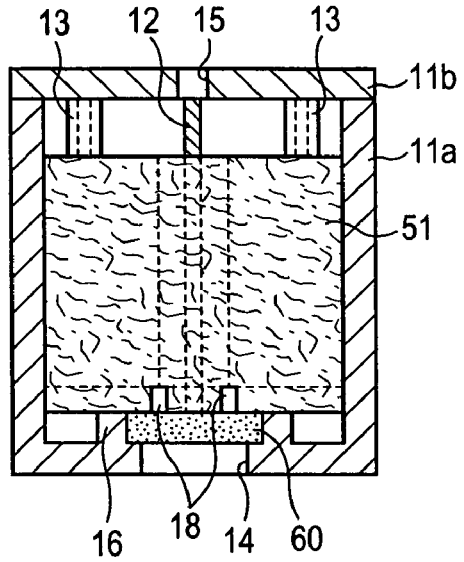
Figure 6C:
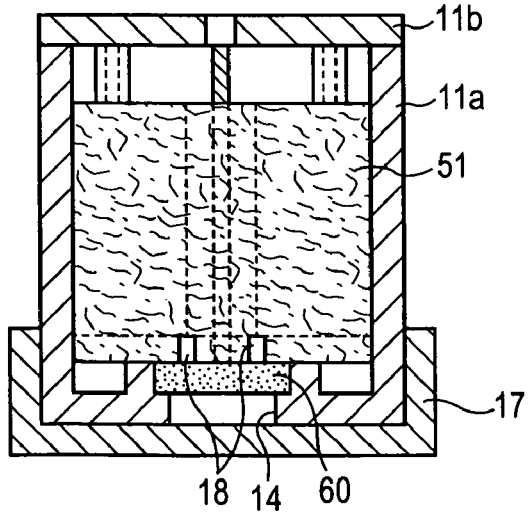

The third embodiment of the present invention will now be described with reference to FIG. 6A to FIG. 6C. In the third embodiment, the same components as those in the first embodiment are given the same reference numerals and their descriptions will be omitted.

A first ink retainer 60 and a second ink retainer 51 are laminated fiber assemblies made of polyolefin thermoplastic resin. The first ink retainer 60 is composed of fibers, each measuring about 6.7 dtex in thickness (about 54 μm in diameter), and the density of the fibers after being compressed is about 0.05 g/cm$^3$. The second ink retainer 51 is composed of fibers, each measuring about 2.2 dtex in thickness (about 1.8 μm in diameter), and the density of the fibers after being compressed is about 0.15 g/cm$^3$. The first ink retainer 60 and the second ink retainer 51 are arranged in a housing 11 such that the direction of fibers, that is, the longitudinal direction (main axis direction) of most fibers constituting these fiber assemblies is substantially orthogonal to the direction in which the first ink retainer 60 and the second ink retainer 51 are brought into contact with an ink receiving tube 33, and at the same time, the direction in which webs of these fiber assemblies are laminated is substantially parallel to the direction in which the first ink retainer 60 and the second ink retainer 51 are brought into contact with the ink receiving tube 33.

Unlike the first and second embodiments described above, the first ink retainer 60 is slightly larger than an ink supply port 14 in size and closes only part of the bottom of an ink tank 10. That is, the first ink retainer 60 is arranged so as to close the ink supply port 14. While the first ink retainer 60 is relatively small in size in the present embodiment, grooves 18 on the second ink retainer 51 function favorably. High reliability for the prevention of ink leakage can thus be achieved similar to the embodiments described above.

Fourth Embodiment

The fourth embodiment of the present invention will now be described with reference to FIG. 7A and FIG. 7B. In the fourth embodiment, the same components as those in the first embodiment are given the same reference numerals and their descriptions will be omitted.

A housing 11 of an ink tank 10 contains a first ink retainer 60 and a second ink retainer 51 that are impregnated with and retain ink. The first ink retainer 60 is disposed between the second ink retainer 51 and the bottom of the ink tank 10. The first ink retainer 60 is in intimate contact with the second ink retainer 51 and blocks the ink supply port 14 from inside the housing 11.

Figure 7A:
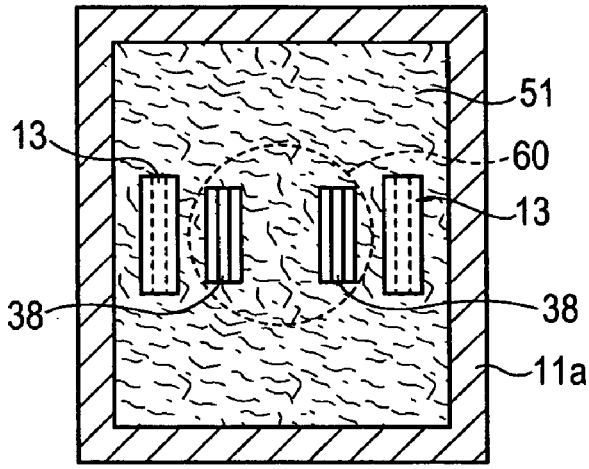
FIG. 7A and FIG. 7B are cross-sectional views showing an ink tank of a fourth embodiment.
Figure 7B:
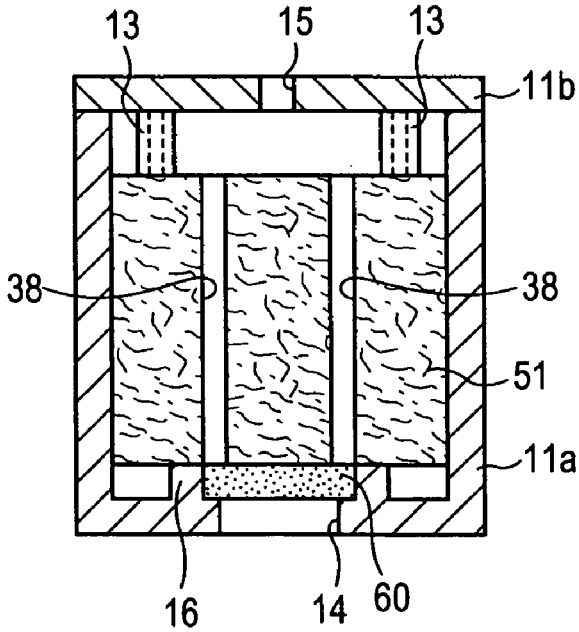
Figure 8:
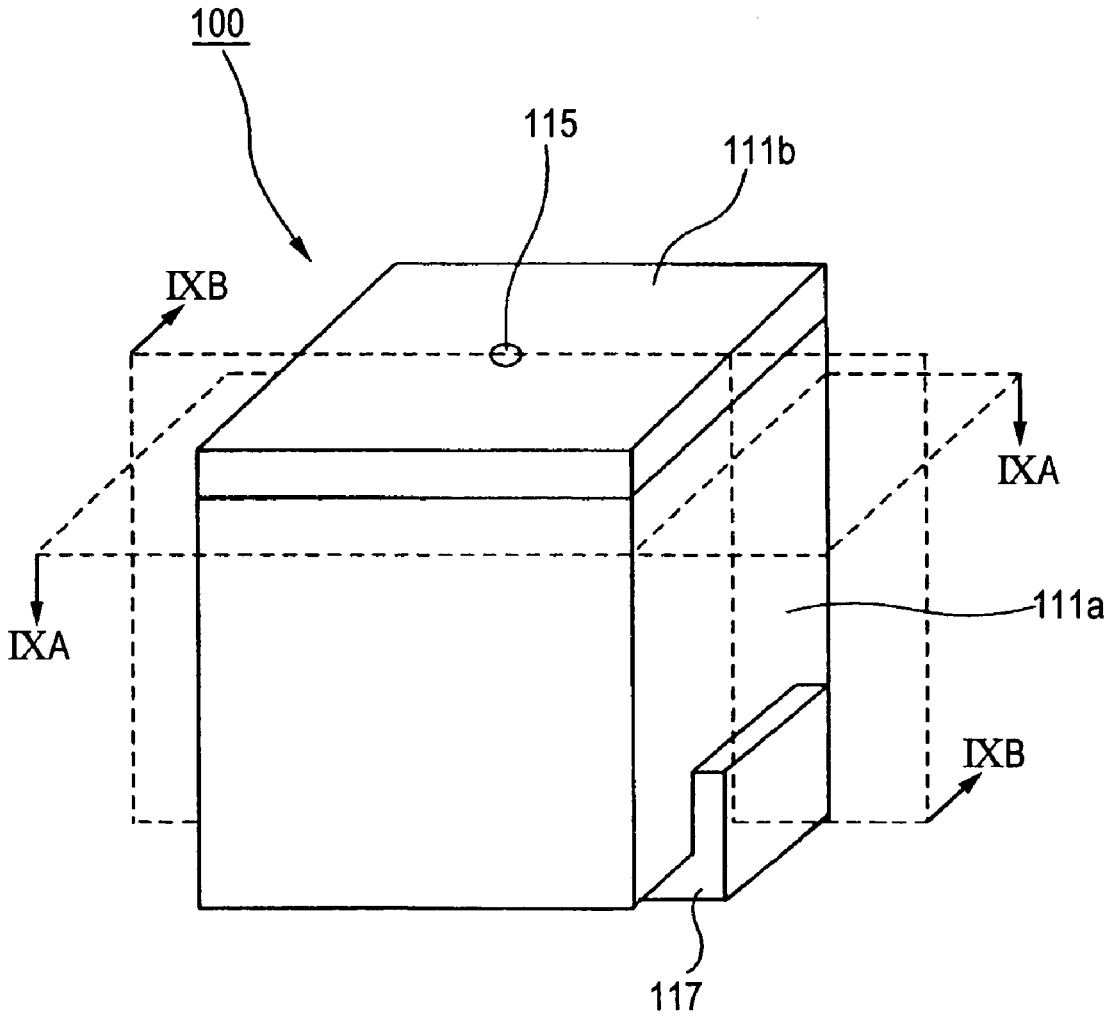
FIG. 8 PRIOR ART
FIG. 8 is an external perspective view of a known ink tank.

As shown in FIGS. 7A and 7B, the second ink retainer 51 is provided with through voids 38 substantially tubular in shape. The through voids 38 extend from a surface (contact surface) in contact with the first ink retainer 60 to a surface (facing surface) opposite an air hole 15, with the center of the contact surface of the second ink retainer 51 interposed between the through voids 38. Each of these through voids 38 opens at both ends on the contact surface and facing surface. These through voids 38 are in parallel to each other with the centers of the contact surface and facing surface interposed therebetween. Thus, the through voids 38 in the second ink retainer 51 create an air path that extends from the contact surface of the first ink retainer 60 toward the air hole 15.

As described above, providing the through voids 38 in the second ink retainer 51 creates an air path. This not only eliminates the need for providing a concave portion or a convex portion (e.g. side rib) on the inner surface of the housing 11, but also eliminates the need for considering and adjusting the connection between the air path on the inner surface of the housing 11 and voids.

The first and second ink retainers that are polyolefin fiber bodies in the above-described embodiments may be structured in different forms and may be made of other materials. Moreover, the density, thickness, and direction of the fibers of the first and second ink retainers are not limited to those of the above-described embodiments.

The color of ink held in the ink tank of the present invention may be black, cyan, yellow, magenta, or the like. The type of ink is also not limited. Liquid held in the ink tank of the present invention is not even limited to ink.

While the ink tank described above is designed for ink of a single color, the ink tank may be a color ink tank that accommodates multiple colors of ink, such as cyan, yellow, and magenta ink.

The air path provided at a portion where the first and second ink retainers are in contact with each other may be shaped and arranged in any manner as long as the level of ink supply performance is maintained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-001354 filed Jan. 6, 2005, which is hereby incorporated by reference herein in its entirety.

What is claimed is:

1. A liquid container comprising:

a liquid retaining member configured to retain a liquid;

a housing adapted to house the liquid retaining member, the housing including:

a liquid supply opening configured to supply the liquid in the liquid retaining member to an external member;

an air intake opening configured to bring air into the housing, wherein the liquid retaining member includes a first liquid retaining member capable of being brought into contact with the external member, and a second liquid retaining member contacting with the first liquid retaining member and configured to supply liquid to the first liquid retaining member, wherein the first liquid retaining member has a liquid retaining force that is larger than that of the second liquid retaining member;

a space reaching the air intake opening defined between the second liquid retaining member and at least one of a concave portion and a convex portion of an inner surface of the housing; and at least one void communicating with the space on the inner surface of the housing is provided within a contact area where the first liquid retaining member and the second liquid retaining member are in contact with each other.

2. The liquid container according to claim 1, wherein the first liquid retaining member includes the void on a surface in contact with the second liquid retaining member.

3. The liquid container according to claim 1, wherein the second liquid retaining member includes the void on a surface in contact with the first liquid retaining member.

4. The liquid container according to claim 1, wherein the first liquid retaining member is formed into an inner shape of a portion of the housing, the portion at which the liquid supply opening is provided.

5. The liquid container according to claim 1, wherein the space is provided on only one side of an inner wall of the housing.

6. The liquid container according to claim 1, wherein a plurality of voids are arranged such that the center of the contact area between the first liquid retaining member and the second liquid retaining member is interposed therebetween.

7. A liquid container comprising:

a liquid retaining member configured to retain a liquid;

a housing configured to house the liquid retaining member, the housing including:

a liquid supply opening configured to supply liquid in the liquid retaining member to an external member;

an air intake opening configured to bring air into the housing, wherein the liquid retaining member includes a first liquid retaining member capable of being brought into contact with the external member, and a second liquid retaining member contacting with the first liquid retaining member and configured to supply liquid to the first liquid retaining member, wherein the first liquid retaining member has a liquid retaining force is larger than that of the second liquid retaining member; and the second liquid retaining member is provided with at least one void extending from a contact area that is in contact with the first liquid retaining member to reach the air intake opening.

8. A liquid ejecting cartridge comprising:

the liquid container according to claim 1;

a holder member configured to detachably hold the liquid container; and a liquid ejecting head configured to eject liquid supplied from the liquid container.

9. A liquid ejecting cartridge comprising:

the liquid container according to claim 2;

a holder member configured to detachably hold the liquid container; and a liquid ejecting head configured to eject liquid supplied from the liquid container.

10. A liquid ejecting cartridge comprising:

the liquid container according to claim 3;

a holder member configured to detachably hold the liquid container; and a liquid ejecting head configured to eject liquid supplied from the liquid container.

11. A liquid ejecting cartridge comprising:

the liquid container according to claim 4;

a holder member configured to detachably hold the liquid container; and a liquid ejecting head configured to eject liquid supplied from the liquid container.

12. A liquid ejecting cartridge comprising:

the liquid container according to claim 5;

a holder member configured to detachably hold the liquid container; and a liquid ejecting head configured to eject liquid supplied from the liquid container.

13. A liquid ejecting cartridge comprising:

the liquid container according to claim 6;

a holder member configured to detachably hold the liquid container; and a liquid ejecting head configured to eject liquid supplied from the liquid container.

14. A liquid ejecting cartridge comprising:

the liquid container according to claim 7;

a holder member configured to detachably hold the liquid container; and a liquid ejecting head configured to eject liquid supplied from the liquid container.

* * * * *